United States Patent [19]

Koike

[11] Patent Number: 4,638,561

[45] Date of Patent: Jan. 27, 1987

[54] COMBINED KNIFE AND SLICER

[75] Inventor: Akira Koike, Takarazuka, Japan

[73] Assignee: Daishoku Kako Kabushiki Kaisha, Itami, Japan

[21] Appl. No.: 756,111

[22] Filed: Jul. 18, 1985

[30] Foreign Application Priority Data

Feb. 22, 1985 [JP] Japan ..... 60-24939[U]

[51] Int. Cl.[4] ..... B26B 3/03

[52] U.S. Cl. ..... 30/284

[58] Field of Search ..... 30/283, 284, 285

[56] References Cited

U.S. PATENT DOCUMENTS

| | | | |
|---|---|---|---|
| 1,470,147 | 10/1923 | Clawson | 30/284 |
| 2,968,867 | 1/1961 | Wolff | 30/284 |
| 3,040,431 | 6/1962 | Colicci | 30/284 |

FOREIGN PATENT DOCUMENTS

| | | | |
|---|---|---|---|
| 453040 | 11/1927 | Fed. Rep. of Germany | 30/284 |

*Primary Examiner*—Jimmy C. Peters

*Attorney, Agent, or Firm*—Gabriel P. Katona

[57] ABSTRACT

A combined knife and slicer comprising an elongated blade having a knife edge, a pair of spaced stub shafts connected to the opposite end portions of the blade so as to extend laterally therefrom, and a spacer guide adjustably carried by the stub shafts and normally biased by a spring element in one direction so as to assume a position spaced a distance from the knife edge in a direction conforming to the cutting direction. The spacer guide includes a spacer bar, the spacing between the spacer bar and the blade defining a thickness of one or more slices which are intended to be produced from a solid food item, for example, a loaf of bread or a ham.

2 Claims, 6 Drawing Figures

1
2
2b
5
7
7b
9
11
11a
12
14
15
H
P
h
t

COMBINED KNIFE AND SLICER

BACKGROUND OF THE INVENTION

The present invention generally relates to a kitchen knife for household use and, more particularly, to a combined knife and slicer which can be used not only as an ordinary kitchen knife, but also as a slicer or slicing knife for cutting a solid food item, for example, a loaf of bread, a ham, a pineapple, a turnip or the like, into one or more slices of predetermined thickness.

Cutting a solid food item with an ordinary kitchen knife to produce even a single slice of 2 to 3 mm in thickness is not an easy task, and extraordinary skill is required to quickly exercise the continuous slicing of a solid food item with the use of an ordinary knife to produce a plurality of, for example, ten, slices of equal thickness. Various types of automated slicers effective to quickly and continuously slice a solid food item to produce one or more slices of equal thickness are currently commercially available, but not only are they expensive and bulky, but they require complicated and time-consuming procedures to clean and keep in ready-to-use condition as they are particularly suited for use in industry and/or shops.

When it comes to a slicer for household use both a hand-operated rotary slicer and a motor-driven version are currently commercially available, but they are still relatively bulky and expensive. They also require a relatively large space for storage when not in use. In addition, not only do they require complicated and time-consuming procedures to disassemble for cleaning purpose, but also they can be used for no other purpose than for slicing.

SUMMARY OF THE INVENTION

Accordingly, the present invention has been developed with a view to substantially eliminating the above discussed disadvantages and inconveniences inherent in the prior art slicers for household use and has for its essential object to provide a novel combined knife and slicer for household use which generally requires no skill in exercising a slicing job to produce slices of, for example, bread or ham of equal thickness, permitting any unskilled person to enjoy the slicing job.

Another important object of the present invention is to provide a novel combined knife and slicer of the type referred to above, wherein the thickness of one or more resultant slices can be adjustable at the will of the user of the combined knife and slicer.

A further object of the present invention is to provide a novel combined knife and slicer of the type referred to above, wherein a guide assembly for converting the knife into a slicer is so removable from the knife blade that not only can the combined knife and slicer can easily be cleaned, but also it can be used as an ordinary kitchen knife when the guide assembly is removed from the knife blade.

A still further object of the present invention is to provide a novel combined knife and slicer of the type referred to above, wherein the guide assembly is simple in structure and easy to manufacture and, yet, can readily be removably secured to the knife blade to make up the slicer.

BRIEF DESCRIPTION OF THE DRAWINGS

These and other objects and features of the present invention will become clear from the detailed description of preferred embodiments thereof made with reference to the accompanying drawings, in which:

FIGS. 3(A), 3(B) and 3(C) are transverse sectional views of the combined knife and slicer showing the sequence of slicing at different positions relative to a solid food item, respectively.

DETAILED DESCRIPTION OF THE EMBODIMENTS

Figure 1:
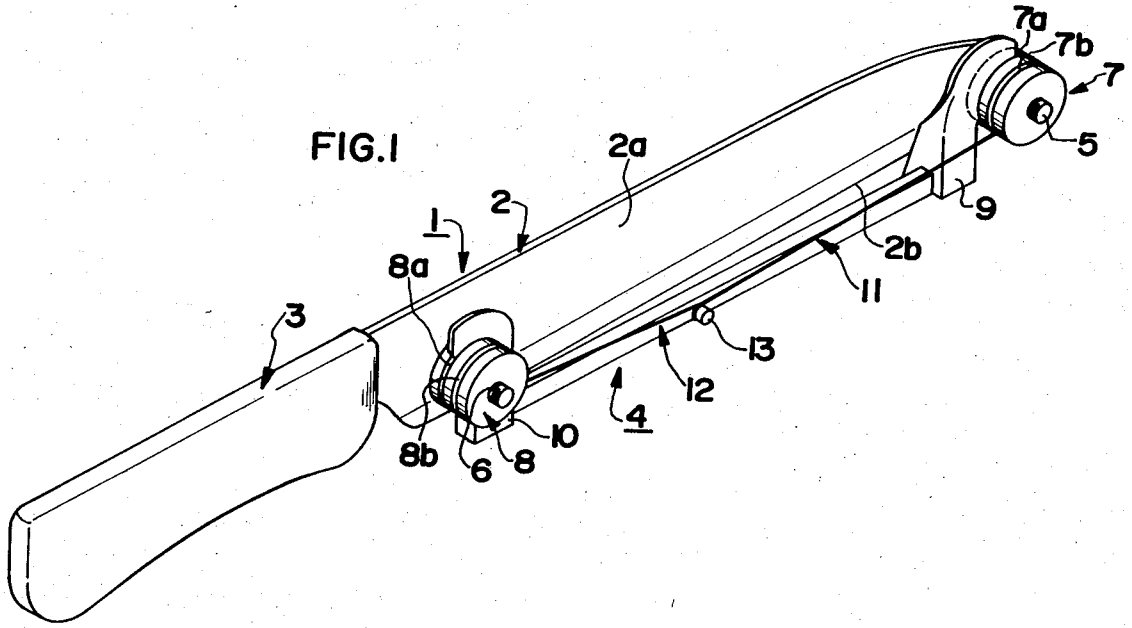
FIG. 1 is a perspective view of a combined knife and slicer according to a first preferred embodiment of the present invention.

Before the description of the present invention proceeds, it is to be noted that like parts are designated by like reference numerals throughout the accompanying drawings.

Figure 2:
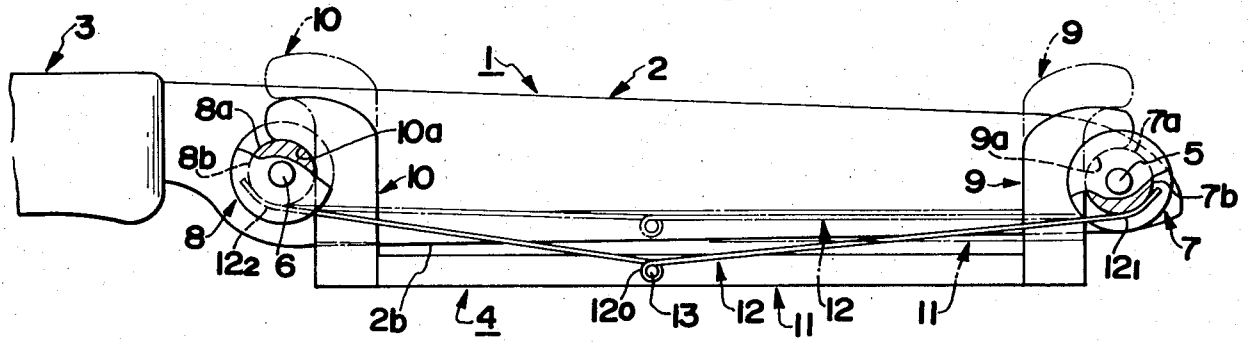
FIG. 2 is a side elevation view of the combined knife and slicer shown in FIG. 1.

Referring first to FIGS. 1 and 2, the combined knife and slicer shown therein comprises a knife 1 including a blade 2 having its tang inserted non-detachably into a handle 3, and a removable guide assembly 4 which, when fitted to the knife blade 2 in a manner as will be described later, converts the knife 1 into a slicer. The blade 2 has a pair of spaced, internally threaded bearing holes defined therein adjacent the tip and the tang thereof, respectively, each of said bearing holes extending completely through the thickness of the blade 2.

The guide assembly 4 comprises a pair of exteriorly threaded stub shafts 5 and 6 threaded at one end thereof into the respective internally threaded bearing holes in the blade 2, respectively, so as to protrude in a direction perpendicular to the knife blade 2, generally cylindrical guide collars 7 and 8 threadingly adjustably mounted on the respective stub shafts 5 and 6, a spacer bar 11 having its opposite ends connected with, or otherwise integrally formed with, respective plate-like support arms 9 and 10 so as to represent a generally U-shaped configuration with the support arms 9 and 10 spaced from each other a distance corresponding to the span between the guide collars 7 and 8, and a wire spring 12 functioning in a manner as will be described later.

Each of the guide collars 7 and 8 adjustably threaded on the respective stub shafts 5 and 6 has its outer peripheral surface formed with a pair of axially spaced, inner and outer grooves 7*a* and 7*b*, or 8*a* and 8*b*, extending circumferentially thereof, the inner groove 7*a* or 8*a* having a groove width generally equal to the thickness of any one of the support arms 9 and 10 while the outer groove 7*b* or 8*b* has a groove width generally equal to the thickness of the wire spring 12. As best shown in FIG. 2, respective free ends of the support arms 9 and 10 remote from the spacer bar 11 are so curved outwardly with respect to each other as to diverge away from each other for the purpose which will become clear from the subsequent description.

With the guide collars 7 and 8 mounted on the respective stub shafts 5 and 6 while the stub shafts 5 and 6 are rigidly secured to the blade 2 by threading them into the respective bearing holes in the blade 2 so as to protrude in the same direction outwardly from one side face 2*a* of said blade 2, an assembly of spacer bar 11 and support arms 9 and 10 is supported by the blade 2 for movement in a plane parallel to the side face 2*a* of the blade 2 with respective outer side edges 9*a* and 10*a* of the support arms 9 and 10 slidingly received in the inner guide grooves 7*a* and 8*a* of the respective guide collars 7 and 8. It is to be noted that each of the outer side edges 9*a* and 10*a* of the respective support arms 9 and 10 is so shaped as to represent the inverted shape of a figure "J" wherefor, when and so long as the assembly of spacer bar 11 and support arms 9 and 10 is downwardly, as viewed in FIG. 2, biased by the wire spring 12 with the spacer bar 11 consequently positioned on the leading side of the blade edge 2*b* with respect to the cutting direction, respective curved end portions of the outer side edges 9*a* and 10*a* of the support arms 9 and 10 are held in contact with the bottoms of the inner guide grooves 7*a* and 8*a* in the guide collars 7 and 8 thereby avoiding the further downward displacement of the assembly of spacer bar 11 and support arms 9 and 10.

The wire spring 12 used to urge the assembly of spacer bar 11 and support arms 9 and 10 downwards so that, as hereinabove described, the spacer bar 11 can be positioned on the leading side of the blade edge 2*b*, has an intermediate portion 12*o* coiled in one or two turns. This wire spring 12 is carried by the spacer frame 11 with the coiled intermediate portion 12*a* thereof mounted on a pin 13 rigidly secured to the spacer bar 12 while the opposite ends of said wire spring 12, which are curved upwardly as at $12_1$ and $12_2$, respectively, are inserted from below into the outer guide grooves 7*b* and 8*b* in the respective guide collars 7 and 8. The assembly of spacer bar 11 and support arms 9 and 10 so biased downwardly by the wire spring 12 can move upwards against the wire spring 12, as shown by the phantom line in FIG. 2, when the spacer bar 11 contacts a support surface, for example, a cutting board (shown by P in FIG. 3(A)) at the end of the cutting operation and the cutting edge 2*b* subsequently reaches the cutting board P.

With the guide assembly 4 movably mounted on the blade 2, by adjusting a spacing between the side face 2*a* of the blade 2 and one side 11*a* (FIG. 3(A)) of the spacer bar 11 adjacent the blade 2 to a desired value, a solid food item, for example, a ham, can be cut to provide a ham slice of a thickness generally equal to the desired value or into a plurality of ham slices of uniform thickness generally equal to the desired value. This adjustment can readily and easily be accomplished merely by turning the guide collars 7 and 8 so that the latter can assume respective positons on the stub shafts 5 and 6 spaced from the blade a distance corresponding to the desired thickness of the slice or slices of ham.

It is to be noted that the spacer bar 11 so far shown and described has a rectangular cross-sectional representation as best shown in FIGS. 3(A) to 3(C). However, it may have any other suitable cross-sectional shape other than the rectangular shape, or it may be employed in the form of an elongated roll in which case the roll may have its opposite ends rotatably connected to the respective support arms 9 and 10.

It is also to be noted that, in order to avoid any possible loosening of one or both of the stub shafts 5 and 6, lock nuts 14 may be threaded from the opposite side of the knife blade 2 to the respective stub shafts 5 and 6 after the latter have been threaded through the internally threaded bearing holes in the blade 2.

While the combined knife and slicer according to the present invention is constructed as hereinbefore described, it can be used in cutting a ham H in the following manner, referring particularly to FIGS. 3(A) to 3(C).

At the outset, as shown in FIG. 3(A), the spacing between the knife edge 2*b* of the blade 2 and the side 11*a* of the spacer bar 11 facing the blade 2 has to be adjusted to a value t corresponding to the desired thickness of one or more ham slices h intended to be produced. As hereinbefore described, this adjustment can be accomplished by turning the guide collars 7 and 8 about the respective stub shafts 5 and 6 successively. After this adjustment has been made, and assuming that the ham H is placed on the cutting board P, the blade 2 is allowed to descend onto the ham H from above while the spacer bar 11 is applied from lateral side with the side 11*a* thereof held in sliding contact with an end face of the ham H, as shown in FIG. 3(A). As the blade 2 is laid down to carve the ham H while the side 11*a* of the spacer bar 11 is kept in sliding contact with the end face of the ham, the ham slice h being formed passes through the spacing between the spacer bar 11 and the side face 2*a* of the blade 2 as shown in FIG. 3(B), it being, however, to be noted that the spacer bar 11 is moving ahead of the blade edge 2*b* of the blade 2 with respect to the cutting direction because of the action of the wire spring 12. The continued application of the downward stroke to the combined knife and slicer even after the spacer bar 11 has been brought into contact with the cutting board P results in that the assembly of spacer bar 11 and support arms 9 and 10 is upwardly shifted against the wire spring 13 relative to the blade 2 while the latter is permitted to continue its descending motion until the blade edge 2*b* is brought into contact with the cutting board P thereby completing the slicing of the ham H to provide the slice h as shown in FIG. 3(C) and as shown by the phantom line in FIG. 2.

It will readily be seen that, by repeating the above described cutting procedure a desired number of time, the ham slices of uniform thickness equal in number to the number of times through which the cutting is repeated can be produced.

The guide assembly 4 once fitted to the knife blade 2 can be removed therefrom. This can be accomplished easily and readily by disengaging the opposite ends $12_1$ and $12_2$ of the wire spring 12 from the associated grooves 7*b* and 8*b* in the guide collars 7 and 8, and then pulling the assembly of spacer bar 11 and support arms 9 and 10 upwardly as viewed in FIG. 2 to allow the support arms 9 and 10 to separate from the guide grooves 7*a* and 8*a* in the guide collars 7 and 8. If desired, one or both of the guide collars 7 and 8 and the stub shafts 5 and 6 may be removed in a manner known to those skilled in the art subsequent to the removal of the assembly of spacer bar 11 and support arms 9 and 10. Specifically, if both of the guide collars 7 and 8 and the stub shafts 5 and 6 are removed, that is, the guide assembly 4 including the stub shafts is completely removed from the knife blade 2, the combined knife and slicer according to the present invention can be used as an ordinary knife. Where the lock nuts 14 are employed such as shown, they must also be removed prior to the removal of the stub shafts 5 and 6 from the blade 2 in order for the combined knife and slicer to be used as the ordinary knife.

Figures 3, 4:
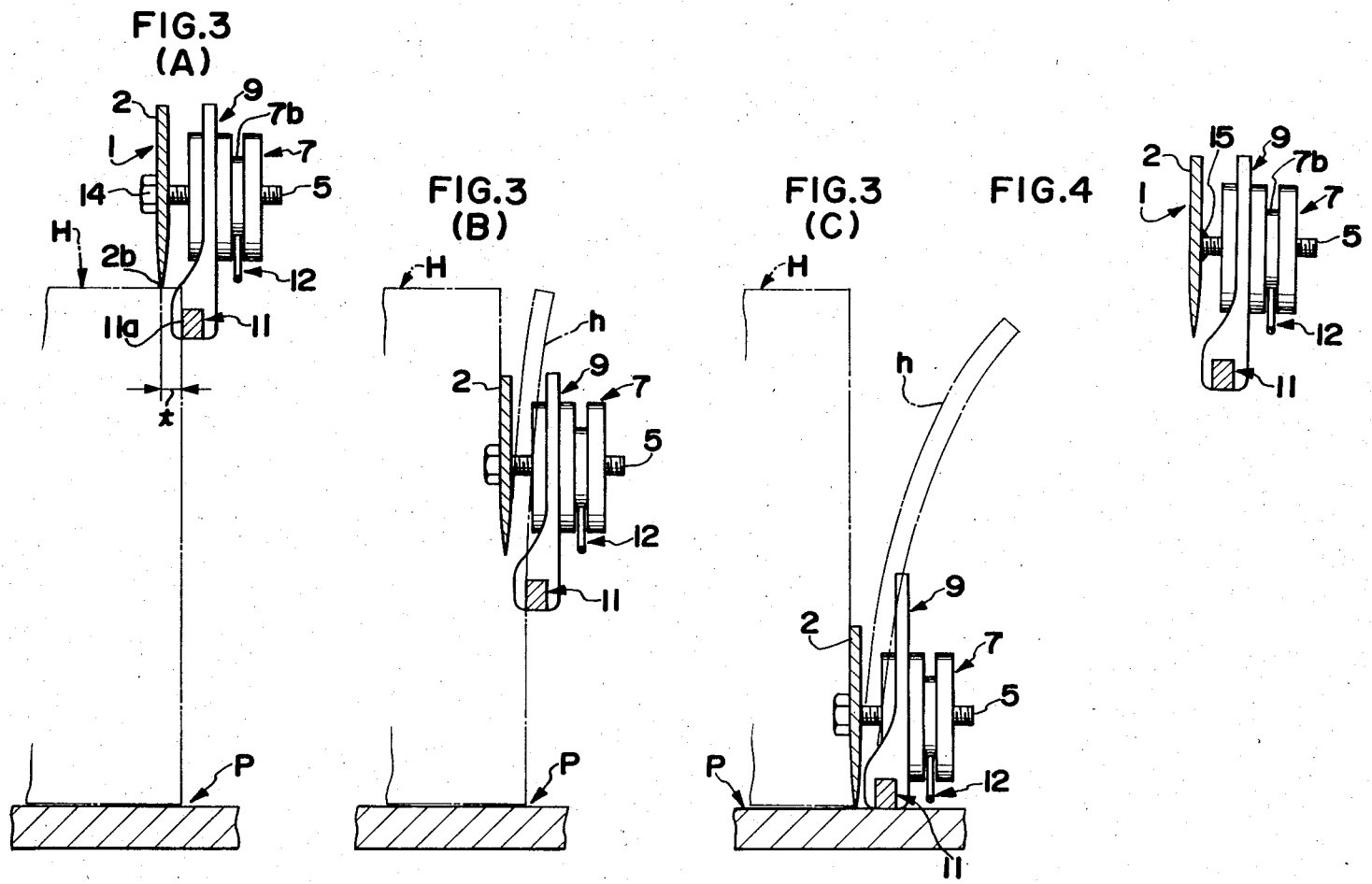
FIG. 4 is a transverse sectional view of the combined knife and slicer according to a second preferred embodiment of the present invention.

The use of the lock nuts 14 may provide an undesirable eyesore to the user. Where it is desired to rigidly secure the stub shafts 5 and 6 to the blade 2 without the nuts, the stub shafts may be welded as at 15 to the blade 2 as shown in FIG. 4. In the embodiment shown in FIG.

4, it is admitted that some inconvenience may arise when the combined knife and slicer according to the embodiment shown in FIG. 4 is used as a knife, i.e., without the guide assembly 4 fitted thereto.

Although the present invention has fully been described in connection with the preferred embodiments thereof with reference to the accompanying drawings, it is to be noted that various changes and modifications are apparent to those skilled in the art without departing from the scope of the present invention as defined by the appended claims. By way of example, each of the stub shafts 5 and 6 may be radially inwardly stepped to provide a reduced diameter end to be inserted through the respective bearing hole in the blade 2. In such case, or separately therefrom, each of the bearing holes in the blade 2 which have been described as internally threaded need not be provided with internal threads.

Also, each of the guide collars 9 and 10 may have any other suitable shape than the cylindrical shape.

Furthermore, the concept of the present invention which has been described and shown as applied to the knife can equally be applicable to a cheese slicer.

Accordingly, such changes and modifications are to be understood as included within the true scope of the present invention unless they depart therefrom.

What is claimed:

1. A combined knife and slicer which comprises a generally elongated knife having a knife edge at one side thereof, a pair of spaced stub shafts connected to the opposite end portions of the blade so as to protrude laterally of the blade in the same direction, a generally elongated spacer guide comprising a spacer bar and a pair of generally plate-like support arms connected to the opposite ends of the spacer bar so as to extend in the same direction at right angles to the spacer bar, said support arms having their outer side edges slidingly received in circumferentially extending guide grooves in guide collars, one for each stub shaft, said guide collars threadingly mounted on each of the stub shafts for permitting the spacer guide to be adjustably supported by said stub shafts so as to extend in parallel relation to the longitudinal sense of the blade and also for adjusting the spacing between the spacer guide and the blade, said guide collars having two circumferentially extending guide grooves defined therein in which a respective portion of the spacer guide is slidingly guided, and a biasing element comprising a wire spring having a substantially intermediate portion secured to the spacer bar, said wire spring having its opposite ends engaged in the second circumferentially extending groove in the respective collars for elastically urging the spacer guide so as to permit the spacer guide to assume a position spaced a distance from the knife edge in a direction parallel to the direction in which the blade is moved during a cutting procedure.

2. A combined knife and slicer as claimed in claim 1, wherein said stub shafts are removably secured to the blade.

* * * * *